US006023863A

United States Patent [19]

Mahin

[11] Patent Number: 6,023,863

[45] Date of Patent: Feb. 15, 2000

[54] FROST HOOK ATTACHMENT FOR BACK-HOE

[76] Inventor: Steven D. Mahin, P.O. Box 73, Dunnell, Minn. 56127

[21] Appl. No.: 09/019,914

[22] Filed: Feb. 7, 1998

[51] Int. Cl.[7] ..... E02F 3/96

[52] U.S. Cl. ..... 37/404; 37/454

[58] Field of Search ..... 37/403, 468, 404, 37/406, 409, 410, 454; 414/723, 912; 172/245, 247, 253, 254

[56] References Cited

U.S. PATENT DOCUMENTS

| | | | |
|---|---|---|---|
| 2,969,966 | 1/1961 | Matheis . | |
| 3,061,123 | 10/1962 | Rogers | 37/404 X |
| 3,702,712 | 11/1972 | Cairns, III | 37/404 X |
| 3,778,111 | 12/1973 | Ciofani . | |
| 4,038,766 | 8/1977 | Felstet . | |
| 4,041,624 | 8/1977 | Fryrear . | |
| 4,204,348 | 5/1980 | Lydie | 37/404 |
| 4,436,477 | 3/1984 | Lenertz et al. | 37/403 X |
| 5,115,583 | 5/1992 | Vail | 37/403 X |
| 5,197,212 | 3/1993 | Vail | 37/403 |
| 5,456,028 | 10/1995 | Larson | 37/410 X |
| 5,581,917 | 12/1996 | Barden | 37/468 |

FOREIGN PATENT DOCUMENTS

| | | | |
|---|---|---|---|
| 2083110 | 3/1982 | United Kingdom | 37/404 |

*Primary Examiner*—Victor Batson
*Attorney, Agent, or Firm*—Roger W. Jensen

[57] ABSTRACT

A frost hook attachment for fixed attachment of connection between a quick-coupler on the outer boom of a back-hoe and the back-hoe bucket, wherein force from the back-hoe boom is transmitted from the quick-coupler to the frost hook and thence to the bucket to which the frost hook is attached, the bucket and frost hook rotating in unison about the main pivotal axis of the bucket.

2 Claims, 3 Drawing Sheets

FROST HOOK ATTACHMENT FOR BACK-HOE

FIELD OF THE INVENTION

This invention relates to a frost hook attachment or auxiliary ripper tooth which can be attached to the outer boom and bucket of a back-hoe for the purpose of digging in the earth with a penetrating tine action, which hook or tooth can be used alternatively or simultaneously with the back-hoe bucket for loosening soil or other material to be picked up by the back-hoe bucket. The frost hook attachment of the present invention is especially useful for penetrating and breaking up frozen ground. It will be further understood that it also may be used for breaking up densely-packed earth such as hardpan or clay.

BACKGROUND OF THE INVENTION

There have been a number of prior art back-hoe hooks or ripper-tooths; see, for example U.S. Pat. Nos. 2,969,966; 3,702,712; 3,788,111; 4,038,766; 4,041,624; 5,115,583; 5,197,212; and 5,456,028. All of these prior art arrangements have one or more disadvantages as compared to Applicant's frost hook.

BRIEF DESCRIPTION OF THE PRESENT INVENTION

The present invention is an auxiliary frost hook attachment for fixed attachment or connection between (i) the quick-coupling unit on the operative end of the boom of the back-hoe and (ii) the back-hoe bucket, wherein the operative force from the back-hoe boom is transmitted via the quick-coupler to the frost hook and thence to the bucket to which the frost hook is attached, the bucket and frost hook rotating in unison about the main pivotal axis of the bucket.

The present invention is distinguished by being very uncomplicated and inexpensive to manufacture. By having very high effectiveness in breaking through frozen ground or hard pan, the present invention may be utilized on one or more of the current standard manufactured back-hoes without any modification thereof being required. The frost hook of the present invention may be attached to the back-hoe quick-coupler manually. However, one of the important advantages of my invention is that the frost hook can be coupled to the quick-coupler solely by the back-hoe operator operating the equipment from his operator's chair.

In broad terms, the frost hook of the present invention includes an elongated arcuately shaped hook having two ends. One of the ends is narrowed and has at the tip thereof a pointed cutting means. The other end of the member has a clevis-like arrangement, i.e., a pair of parallel disposed portions with a pin means transversely supported by the two clevis legs. The member further has a hub adjacent the clevis and a transverse hole position intermediate the hub and the cutting means and spaced from the hub a preselected distance equal to the distance between first and second set of holes in flanges attached to the back wall of the bucket.

GENERAL DESCRIPTION OF THE DRAWINGS

Figure 5:
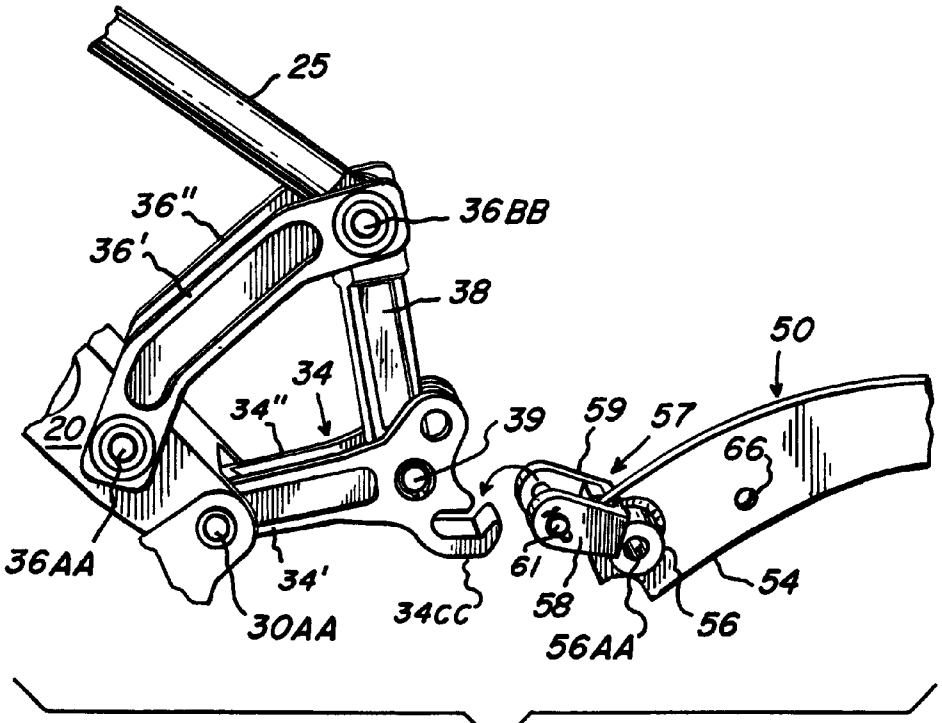
Figure 4:
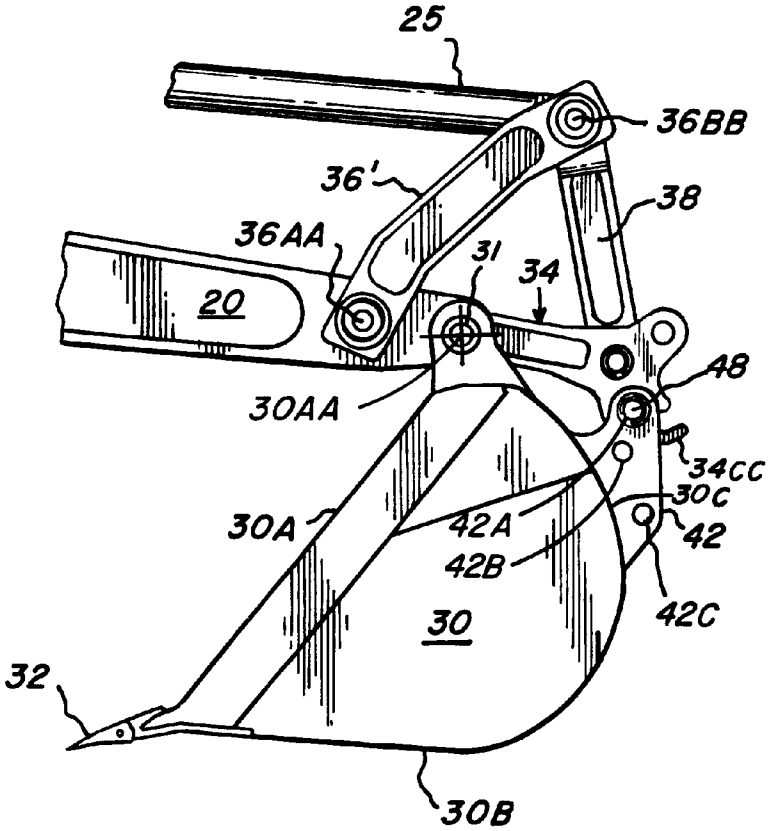
FIG. 4 (Prior Art)
Figure 7:
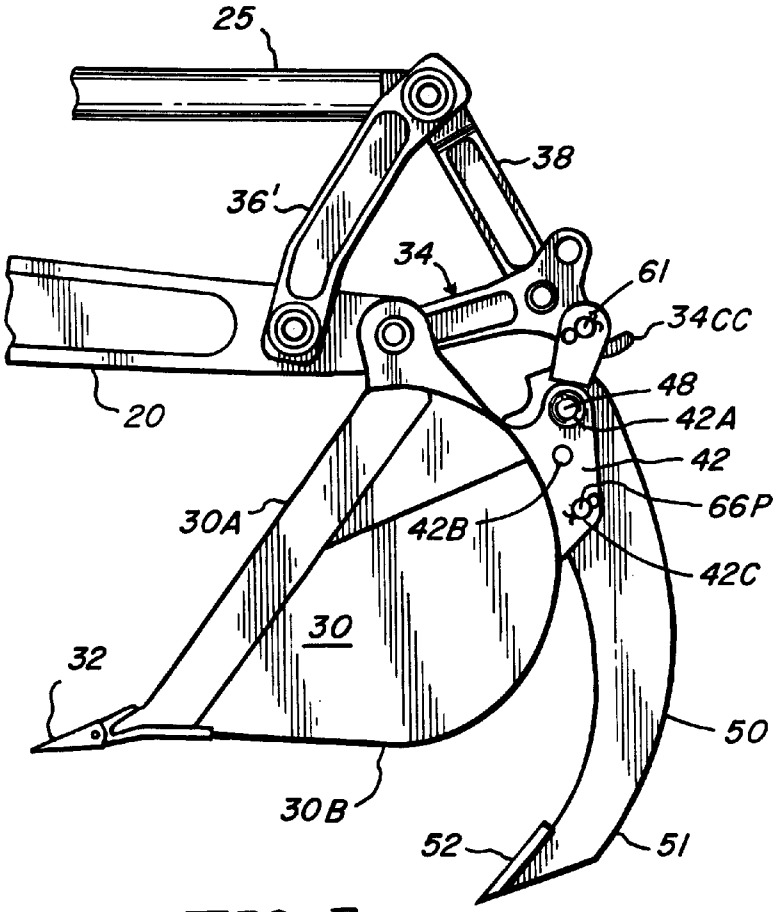
Figure 6:
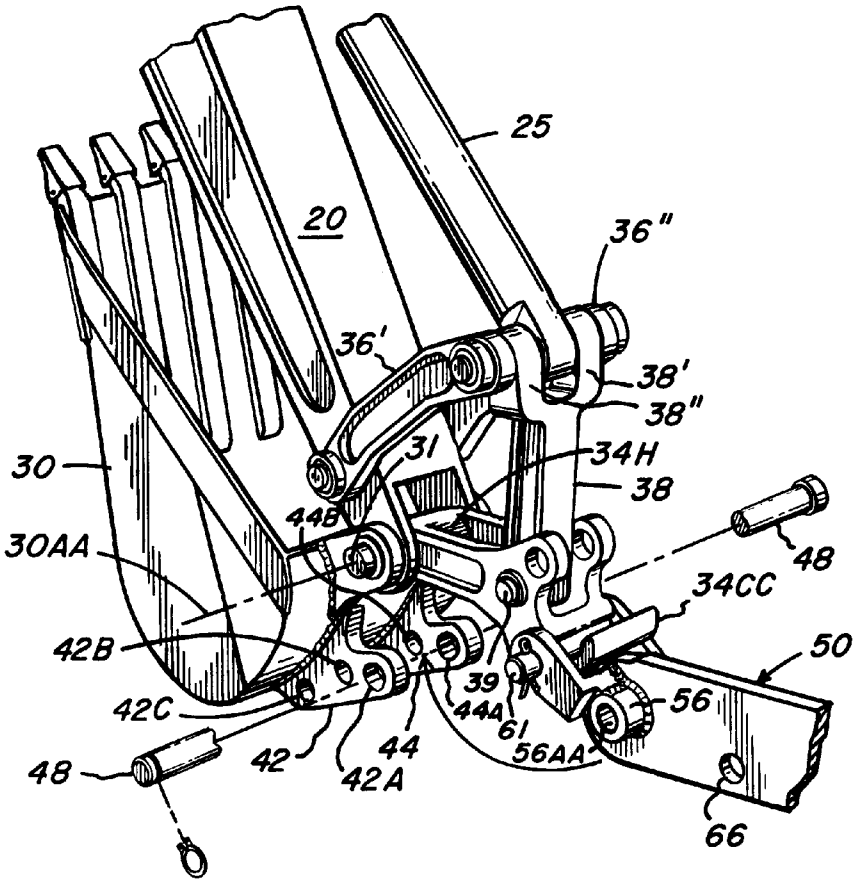

FIG. 4 shows a detailed view of the back-hoe bucket in its normal configuration, i.e., without the frost hook, the quick-coupler hook 34CC engaging or coupled with a pin 48 positioned in holes 42A and 44A of flanges 42 and 44 attached to the backside of the bucket 30;

FIG. 5 shows an isometric view of the quick-coupler mounted on the end of the outer boom, adapted to engage or be coupled with the pin 61 of the clevis 57 at one end of the frost hook attachment of this invention;

FIG. 6 is an isometric view of a portion of my frost hook as engaged in the quick-coupler but prior to the frost hook being attached to the supporting flanges of the back side of the bucket; and FIG. 7 shows a side view of the assembled bucket and frost hook.

DETAILED DESCRIPTION OF THE PREFERRED EMBODIMENT

There are, of course, a number of earth-moving machines employing one or more shovels or buckets. For purposes of describing the present invention, the same is illustrated and described in connection with a typical earth-moving machine commonly referred to as a back-hoe, it being understood of course that the invention may be utilized in conjunction with other types of earth moving apparatus.

Back-hoe type earth digging machines are widely used for shallow excavating work because of their flexibility and ease of control. The basic principle of operation of a back-hoe is as follows:

A powered vehicle has a main boom sturdily attached at the first of two ends thereof to the vehicle; first hydraulic means connected to the vehicle and to the main boom controllably rotate the main boom about its pivotal axis.

At the other end of the main boom is pivotally attached a first end of an outer boom and second hydraulic means connected to said booms is controllable for rotating the outer boom about its pivotal axis with respect to the main boom. An earth-scooping bucket is mounted at the other end of the outer boom with its digging edge facing generally towards the base of the vehicle or machine. A quick-coupler arrangement is provided at the other end of the outer boom for coupling with the bucket. The digging edge of the bucket is facing generally towards the base of the machine and may be moved downwardly into the earth and at the same time moved towards the base of the machine.

Figure 1:
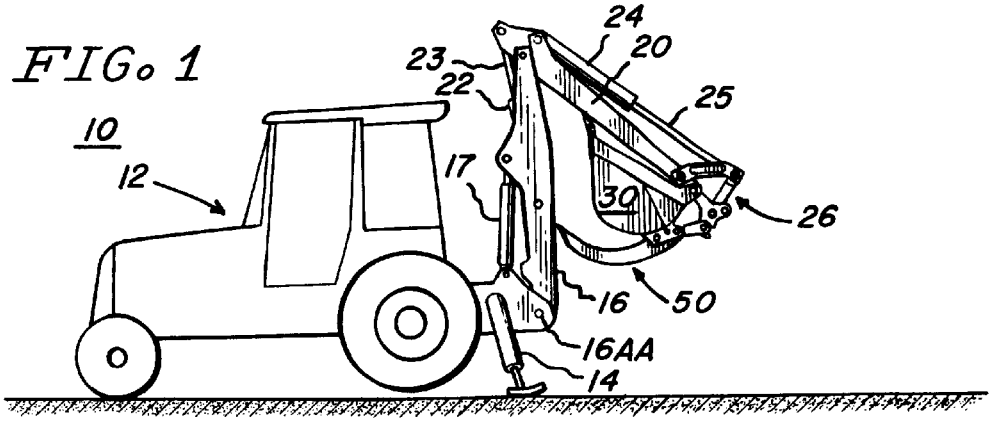
FIG. 1 shows a back-hoe machine with the booms in nested position.
Figure 2:
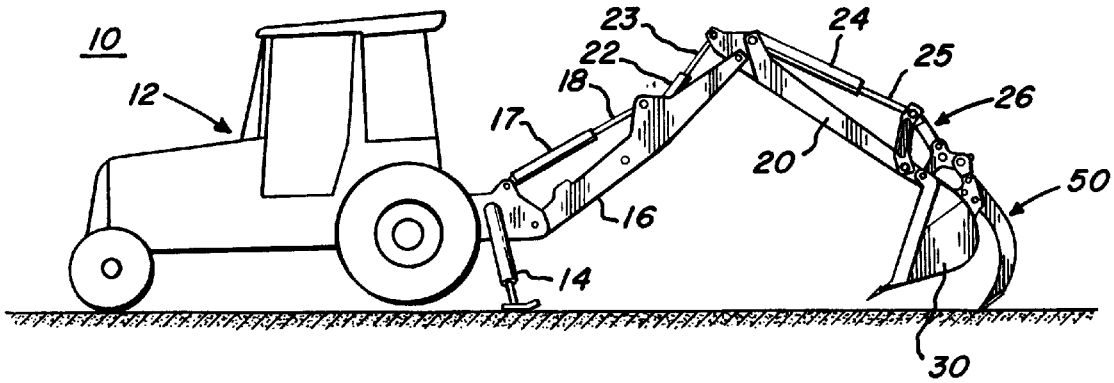
FIG. 2 shows the back-hoe machine with the booms extended.
Figure 3:
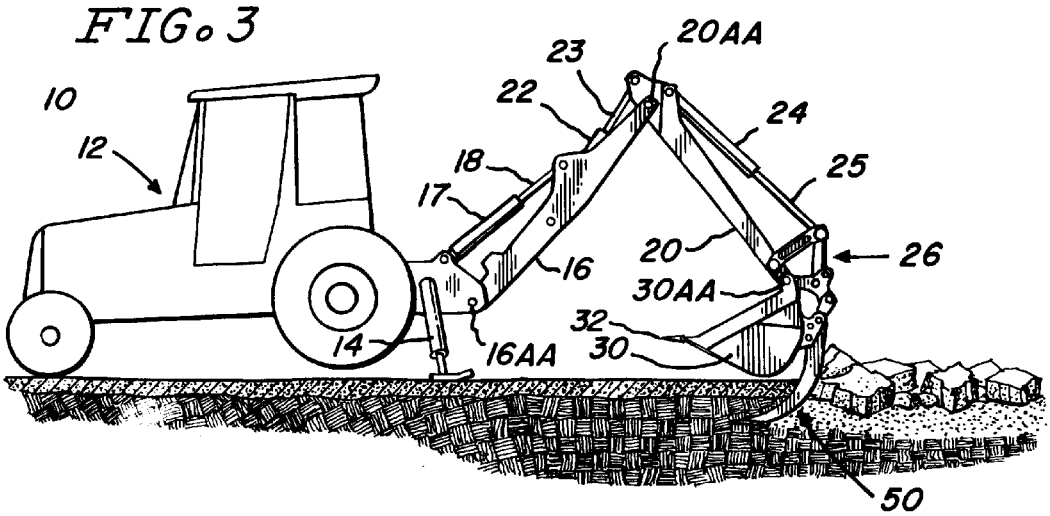
FIG. 3 shows the back-hoe machine in a digging position.

Referring to FIGS. 1, 2 and 3, the reference numeral 10 generally designates a back-hoe system which includes a powered vehicle 12 which provides the power required to operate the back-hoe and which establishes a fixed base-point toward and away from which the back hoe is moved during its operation. Powered vehicle 12 is shown in the drawings to be a wheeled tractor, the rear end of which has stabilizers 14; other powered vehicles are familiar to those skilled in the art.

A main boom 16 is pivotally attached at 16AA to the vehicle 12. A first hydraulic means is connected to the vehicle and to the main boom for controllably rotating the main boom about its pivotal axis. The hydraulic means is identified in FIG. 3 as a cylinder 17 having one end connected to the vehicle with a piston rod 18 connected to the main boom 16.

An outer boom 20 is pivotally attached to the first of two ends thereof, to the second end of the main boom 16, this pivotal connection being identified as 20AA in FIG. 3. A second hydraulic means 22/23 connected between booms 16 and 20 may be controlled so as to rotate outer boom 20 with respect to the main boom 16 about its pivotal axis 20AA. A reference to FIGS. 1, 2 and 3 will show the main boom 16 and outer boom 20 in different relative positions about their rotational axes 16AA and 20AA respectively.

A bucket 30 having bucket teeth 32 is supported for rotation relative to the outer boom 20, the bucket being attached to and rotatably supported at the end of the outer boom, the pivotal axis 30AA thereof, being clearly depicted in FIGS. 3, 4, 5 and 6. A third hydraulic means in the form of a cylinder 24 and piston rod 25 are connected between the outer boom 20 and the bucket so as to controllably rotate the bucket with respect to the outer boom 20 about the bucket rotational axis 30AA. Reference numeral 26 in FIG. 3 generally designates a linkage between the piston rod 25 and bucket, and can be more easily understood by reference to FIGS. 4–7. The bucket 30 has a mouth 30A, a bottom 30B and a backside 30C.

FIG. 4 shows a side-view of the bucket 30 supported, as aforesaid, for rotation about axis 30AA. A pin 31 rotatably connects the bucket 30 to boom 20. A quick-coupler 34 has a hub 34H rotatably mounted on pin 31 (see FIG. 6) with two spaced-apart parallel extending portions 34' and 34" which, at the other end thereof, are combined to form a quick-coupling hook 34CC. The linkage further includes a pair of crosslinks 36' and 36" positioned at one end thereof on opposite sides of the outer boom 20 and secured thereto by pin means 36AA, and connected or positioned at the other ends thereof on opposite sides of a yoke-like end of a connecting arm 38, one end of the piston rod 25 being positioned between the two arms 38' and 38", the other end of arm 38 being rotatably connected to the quick-coupler 34 with a pin 39.

Attached as by welding to the back side 30C of the bucket, are a pair of flange members 42 and 44 which generally extend parallel to one another and which have, as shown in FIG. 6, three holes 42A, 42B and 42C, and 44A, 44B and 44C respectively (hole 44C is hidden in FIG. 6). Holes 42A–C and 44A–C are in mutual self-register and used in combination selectively with a pin 48 in the normal operation of the bucket to determine the angle of the bucket with respect to the outer boom 20. To further explain, when the bucket is being used without the frost hook, then the pin 48 would be inserted, for example, through holes 42A and 44A and would be engaged by hook portion 34CC of the quick-coupler; this is the arrangement shown in FIG. 4. It will be understood that movement of piston rod 25 with respect to its hydraulic cylinder 24 will cause rotation of the bucket with respect to the boom 20 about axis 30AA. The force from the piston rod is transmitted through the above-described linkage to the quick-coupler 34 and thence to the pin 48 connected to the bucket 30.

The back-hoe apparatus thus far described is generally descriptive of a Model 580 Super K Back-Hoe distributed by the Case Company. As indicated, the inventive concept may be applied to other back-hoe machines.

The improved frost hook provided by this invention is identified in FIG. 7 by reference numeral 50; it is an elongated arcuately shaped hook-like unitary member having a longitudinal extent substantially the same as the distance between the pivotal axis 30AA of the bucket and the bucket teeth 32. In the preferred embodiment, the hook 50 is fabricated out of high-strength sheet or slab steel and is dimensioned to have sufficient strength for its intended purpose. As shown in FIG. 7, the hook tapers downwardly toward one end 51 with the extreme end therefor pointed and fitted with a suitable cutting surface 52. The other end of the hook is identified by reference numeral 54 and is shown in greater detail in FIGS. 5 and 6. A hub 56 having a bore 56AA therethrough is positioned at end 54 of the hook; also at this end is a clevis-like member 57 having two parallel arms 58 and 59. Arms 58 and 59 are apertured at their ends to receive a pin 61 which is sized so that it may be engaged by or coupled with the quick-coupler hook 34CC.

An important feature of the frost hook is a bore or aperture 66 which is positioned between hub 56 and cutting surface 52, and the centerline thereof is separated from the axis of bore 56AA by a distance exactly equal to the distance between the centerlines or holes 42A and 42C, and 44A and 44C (see FIGS. 5 and 6).

OPERATION

The utilization and operation of my invention is very convenient and efficient. First, assuming the back-hoe has been used in the standard mode as shown in FIG. 4, the operator would let the bucket rest on the ground and then remove pin 48. Then the operator retracts piston rod 25 somewhat to cause the quick-coupler hook 34CC to be clear of the flanges 42 and 44. At this point the frost hook 50 can be manually lifted so clevis pin 61 is fully coupled with hook 34CC.

Alternatively (to avoid the manual lifting) the operator can, by manipulation of the booms, couple the hook 34CC with pin 61 as follows. After pin 48 is removed as aforesaid, the bucket is rotated so that the bucket teeth are much closer to boom 20 than as shown in FIG. 4; this exposes hook 34CC, i.e., clear from flanges 42 and 44. Then the operator causes the hook 34CC to move horizontally into engagement with pin 61. Then the boom 20 is raised up; this causes the bucket to rotate counter-clockwise as shown in FIG. 7 to a point where (i) pin 61 is fully coupled with hook 34CC (to the left end of hook 34CC as shown in FIG. 5), (ii) hub bore 56AA is aligned with bores 42A and 44A, and (iii) bore 66 is aligned with bores 42C and 44C; then pins 48 and 66P are inserted as shown in FIG. 7. The foregoing sequence is premised on the frost hook 50 being vertically positioned with pin 61 horizontal.

After pins 48 and 61 are inserted, the frost hook 50 is thus rigidly attached to the bucket 30 and receives force from the piston rod 25 through the quick-coupler 34 and the linkage 36'-36" and 38.

The frost hook is configured to first of all provide a very effective means for breaking through frozen ground and/or densely-packed ground, the frost hook first penetrating the earth and then by being dragged through the ground by the back-hoe, breaking up frozen soil into small enough pieces so that the same may be scooped up by the bucket 30. It will be understood that the bucket 30 may continue functioning as a bucket even though the frost hook 50 is attached, this being depicted in FIG. 2. Simultaneous functioning of the bucket and the frost hook also can occur, i.e., while the bucket is scooping up material, the frost hook simultaneously can be digging up material at a lower elevation.

The spacing between the cutting surface 52 on the hook 50 and the bottom surface of the bucket (see FIG. 7) can advantageously be used as a gripping or holding means for transferring large slabs of material such as a broken up sidewalk.

What is claimed is:

1. A frost hook attachment for a back-hoe system wherein said system comprises:

a powered vehicle having a main boom having first and second ends pivotally attached to said vehicle at said first end thereof for rotation about a first pivotal axis;

first hydraulic means connected to said vehicle and said main boom for controllably rotating said main boom about said first pivotal axis;

an outer boom having first and second ends attached at said first end thereof to said second end of said main boom for rotation about a second pivotal axis;

second hydraulic means connected to said booms for controllably rotating said outer boom about said second pivotal axis;

a bucket having a front opening with bucket teeth, a bottom and a back side, and being pivotally supported on said outer boom adjacent said second end of said outer boom for rotation about a third pivotal axis;

a pair of spaced-apart parallel flanges attached to said backside of said bucket;

first and second spaced apart sets of pin-receiving holes in said flanges in mutual self register;

a first pin removably positioned in said first set of pin-receiving holes of said flanges;

a quick coupling means having (i) first and second ends pivotally attached at said first end thereof to said second end of said outer boom for rotation about said third axis, and (ii) at said second end thereof a quick coupling hook, said quick coupling hook being positioned about said third axis to engage said first pin positioned in said first of said sets of pin-receiving holes of said flanges; and third hydraulic means connected to said outer boom and to said second end of said quick coupling means for controllably rotating said bucket around said third pivotal axis;

said frost hook attachment comprising:

an elongated arcuately shaped, hook-like unitary member having first and second ends and a longitudinal extent substantially the same as the distance between the pivotal axis of said bucket and said bucket teeth of said bucket, a pointed cutting member at said first end thereof, a transversely disposed hub having a bore and positioned adjacent the second end of said hook-like member, a clevis-like member having a pair of parallel disposed extended portions, said clevis-like member being rigidly attached to said hook-like unitary member at said second end thereof, a second pin transversely supported by and fixed to said parallel disposed extended portions of said clevis-like member, said second pin being sized so as to be received by and coupled by said quick coupling means, and a transverse hole positioned intermediate said hub and said cutting member and disposed from said hub bore a preselected distance equal to the distance between said first and second sets of holes in said flanges, whereby said frost hook attachment may be utilized only with said back-hoe system as follows:

a. said first pin is removed from said first set of pin-receiving holes of said flanges, following which said quick coupling hook is coupled to said second pin to thus connect said quick coupling hook to said frost hook attachment, b. said hub bore and said transverse hole of said frost hook attachment are aligned in register with said first and second sets of holes in said flanges respectively, and, c. a third pin is inserted through (i) said aligned hub bore and said first set of holes, and (ii) said aligned transverse hole and said second set of holes, thereby connecting said frost hook attachment to said bucket, actuation of said third hydraulic means transmitting force, as aforesaid, to said quick coupling hook and thence to said second pin means, to cause simultaneous rotation of said frost hook and said bucket about said third axis.

2. Apparatus of claim 1 further characterized by said frost hook attachment being shaped so that, when attached to said back-hoe system as aforesaid, a substantial spacing is provided between said bottom of said bucket and said pointed cutting means on said frost hook attachment, whereby said frost hook and bucket may function as a holding means for holding material.

* * * * *